United States Patent [19]

Efstratis

[11] Patent Number: 4,519,102

[45] Date of Patent: May 28, 1985

[54] GARBAGE DISPOSAL GUARD

[76] Inventor: Ernest Efstratis, 6775 Wing Lake Rd., Birmingham, Mich. 48010

[21] Appl. No.: 559,621

[22] Filed: Dec. 7, 1983

Related U.S. Application Data

[63] Continuation-in-part of Ser. No. 294,722, Aug. 20, 1981, abandoned.

[51] Int. Cl.[3] ..... E03C 1/26

[52] U.S. Cl. ..... 4/292; 241/46 A; 210/497.01

[58] Field of Search ..... 4/286–292, 4/629, 652, 654, DIG. 4, DIG. 19; 241/32.5, 46 A, 46 B, 257 G; 210/163–166, 497.01

[56] References Cited

U.S. PATENT DOCUMENTS

| | | | |
|---|---|---|---|
| 738,726 | 9/1903 | Lytle | 4/292 |
| 1,292,856 | 1/1919 | Niblo | 4/287 |
| 1,594,361 | 8/1926 | Frankenstein | 4/289 |
| 1,596,893 | 8/1926 | Schifter | 4/287 |
| 2,075,443 | 3/1937 | Kirschner et al. | 4/287 |
| 2,761,626 | 9/1956 | Gustaveson | 241/100.5 X |
| 2,837,212 | 6/1958 | Schmid | 210/166 |
| 2,881,921 | 4/1959 | Baker et al. | 210/166 |
| 2,902,700 | 9/1959 | Chambers | 241/100.5 X |
| 4,044,409 | 8/1977 | Hood | 4/286 |

FOREIGN PATENT DOCUMENTS

| | | | |
|---|---|---|---|
| 71639 | 10/1893 | Fed. Rep. of Germany | 210/163 |
| 568171 | 12/1932 | Fed. Rep. of Germany | 4/288 |
| 1024046 | 3/1953 | France | 4/287 |

*Primary Examiner*—Charles E. Phillips

*Attorney, Agent, or Firm*—Barnes, Kisselle, Raisch Choate, Whittemore & Hulbert

[57] ABSTRACT

A garbage disposal guard comprising a sleeve having an upper cylindrical wall portion and a lower cylindrical base portion of smaller diameter than the upper wall portion and joined thereto by a shoulder portion. The sleeve is adapted to be installed in the drain of a sink equipped with a garbage grinder with its shoulder portion seated on a portion of the sink surrounding the drain, its base portion extending down into the drain and its upper wall portion projecting up above the drain. Slots are provided in the sleeve to permit an adequate flow of water. The slots are sufficiently narrow to prevent flatware and the like from washing down the drain and into the grinder. The sleeve may be longitudinally split to permit it to be circumferentially squeezed or compressed so that it will fit drains of different sizes.

1 Claim, 4 Drawing Figures

GARBAGE DISPOSAL GUARD

REFERENCE TO RELATED APPLICATION

This is a continuation-in-part of my prior copending application Ser. No. 294,722 filed Aug. 20, 1981 now abandoned.

This invention relates to a garbage disposal guard and refers more particularly to a guard adapted to be installed in the drain of a sink equipped with a garbage grinder for the purpose of preventing flatware and the like from falling down the drain into the grinder.

BACKGROUND AND SUMMARY OF THE INVENTION

In the operation of garbage grinders of the type installed beneath the sink drain, there has been the problem of preventing flatware and like articles from being washed into the grinder and severely damaged. Also, severe damage to the grinder can occur. Stoppers have been used to close or partially close the drain, but these interfere with the flow of water.

One object of this invention is to provide a guard which will prevent flatware and the like from falling down the drain into the garbage grinder, but which will not materially interrupt the flow of water. In accordance with the invention about to be described, the guard is in the form of a sleeve having an upper cylindrical wall portion and a lower cylindrical base portion of smaller diameter than the upper wall portion. The upper wall portion and the base portion are integrally joined by an annular shoulder portion. The sleeve is installed in the drain with its shoulder portion seated on a portion of the sink surrounding the drain, its base portion extending down into the drain and its wall portion projecting up above the drain. The upper wall portion provides a barrier preventing flatware and the like from being washed down the drain. The upper wall portion is of relatively large diameter so that garbage may be put into the disposal without removing the guard. Passage means are provided in the sleeve to allow an adequate flow of water down the drain from efficient operation of the grinder.

Another object is to provide a guard which is adjustable to fit sink drains of different sizes.

These and other objects of the invention will become more apparent as the following description proceeds, especially when considered with the accompanying drawings.

DETAILED DESCRIPTION

Figure 1:
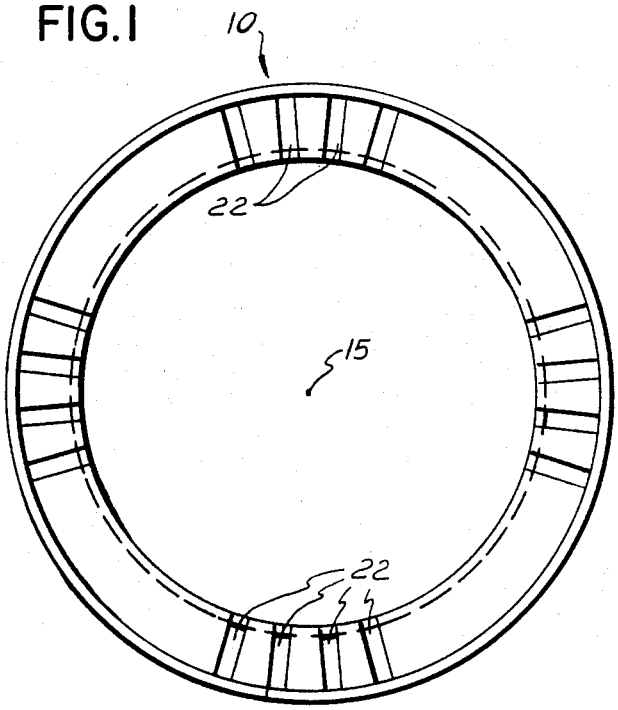
FIG. 1 is a top plan view of a garbage disposal guard constructed in accordance with my invention.

Referring now more particularly to the drawings, the garbage disposal guard is in the form of a sleeve 10 having an upper cylindrical wall or wall portion 12 and a lower cylindrical base or base portion 14 of smaller diameter than and concentric with the upper wall portion 12. The sleeve is of one-piece construction formed of a flexible resilient material such as a suitable plastic, for example. It is of uniform thickness throughout its full extent and its interior is open and unobstructed from top to bottom.

The wall and base portions 12 and 14 are integrally joined by an annular shoulder portion 16. The shoulder portion 16 is disposed at right angles to the wall and base portions 12 and 14 and also to the common longitudinal center line 15 of the wall and base portions. The shoulder portion 16 merges into the wall and base portions in arcs or curves generally indicated at 18 and 20.

The sleeve is provided with passage means in the form of a plurality of slots 22 which are laterally spaced equal distances from one another around the full peripheral extent of the sleeve. These slots are elongated and each lies in a plane which contains the longitudinal center line of the sleeve. Each slot extends from its upper extremity 24 located near or slightly above the mid-point in the height of the wall portion 12 down through the wall portion 12, then through the shoulder portion 16 and then continues to its lower extremity 26 in the upper part of the base portion 14. Each slot is continuous from one end to the other and sufficiently narrow to prevent the passage of flatware and the like, although there are many slots in order to allow a large volume of water to pass.

Figure 2:
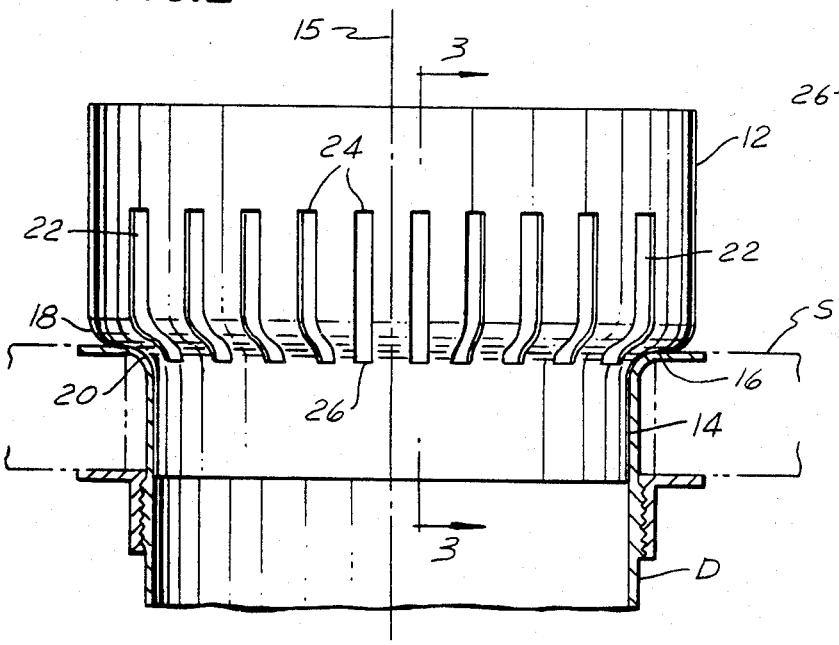
FIG. 2 is a side elevational view of the guard shown installed in the drain of a sink.

The sleeve in FIG. 2 is shown installed in the drain D of a sink S. The base portion 14 of the sleeve is of slightly smaller diameter than the drain so as to fit easily within the drain with the shoulder portion 16 of the sleeve resting on that portion of the sink which surrounds the drain. In this position, the walls 12 and 14 of the sleeve extend vertically and the shoulder portion 16 extends horizontally.

With the water faucet turned on, water in the sink may enter into the drain freely through the slots 22. However, flatware and the like in the sink will be prevented from falling into the drain by the barrier wall 12 since the slots are too narrow to accept even the smallest piece of flatware. Therefore, the guard will prevent flatware and the like from being damaged by the garbage grinder (not shown) installed in the drain beneath the level shown in FIG. 2, but will not interfere with the adequate flow of water. The guard also prevents flatware and the like from damaging the grinder. Also, the large diameter opening at the top of the guard permits garbage to be put into the disposal without removing the guard.

Figure 4:
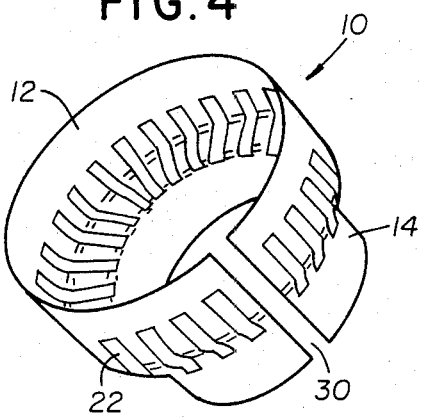
FIG. 4 is a perspective view of a modification.
Figure 3:
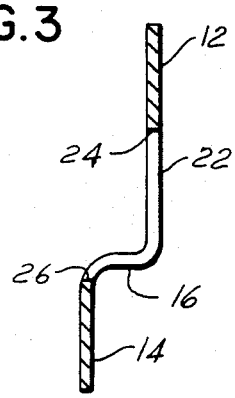
FIG. 3 is a sectional view taken on the line 3—3 in FIG. 2.

FIG. 4 shows a modified guard which is the same as the guard in FIGS. 1–3 except that it is longitudinally split or slotted where indicated at 30 from the upper edge of the wall portion 12 continuously down through the lower edge of the base portion 14. Because of the slot 30, the sleeve can be circumferentially squeezed or compressed by hand to a smaller diameter, allowing its base portion to fit a drain of smaller diameter than the one shown in FIG. 2. The slot is wide enough to permit a substantial reduction in sleeve diameter without overlap of the edges defining the slot. Hence, the sleeve of FIG. 4 is capable of fitting drains of different sizes.

I claim:

1. A garbage disposal guard comprising a sleeve of flexible, resilient plastic material having an upper substantially cylindrical wall portion of relatively large diameter which is open at the top and a lower substantially cylindrical base portion of smaller diameter than and concentric withsaid wall portion and which is open at the bottom, said wall and base portions being integrally joined by a substantially annular shoulder portion which is disposed substantially perpendicular to said wall and base portions, said shoulder portion merges into said wall and base portions via arcuate portions, said sleeve being adapted to be installed in the drain of a sink equipped with a garbage grinder with its shoulder portion seated upon a portion of the sink surrounding the drain, its base portion extending down into the drain and its wall portion projecting up above the drain, and passage means in said sleeve permitting the flow of liquid from said sink into said drain when said sleeve is installed as aforesaid, said passage means comprising a multiplicity of equally laterally spaced, elongated parallel slots extending through the wall, arcuate portions shoulder and base portions of said sleeve and each disposed in a plane which contains the longitudinal center line of said sleeve, the upper end of each slot being disposed near the mid point of said wall portion in spaced relation above said shoulder portion, each slot extending from its upper end downwardly through the lower part of said wall portion, through said shoulder portion and arcuate portions to its lower end above the bottom edge of said base portion, said slots being relatively narrow but sufficient in number to allow a large enough volume of water flow for the efficient operation of the garbage grinder yet each being sufficiently narrow to prevent flatware and the like from passing through and falling down the drain into the grinder, said sleeve being of one-piece construction and of uniform thickness throughout its full extent, the interior of said sleeve being open and unobstructed from top to bottom so that garbage may be introduced into the relatively large diameter wall portion and passed through the guard and into the grinder while the guard is installed as aforesaid in the drain of the sink, said sleeve being longitudinally split from the upper edge of said wall portion continuously down through the lower edge of said base portion to permit said sleeve to be circumferentially compressed to a smaller diameter in order to fit into drains of different diameters.

* * * * *